United States Patent [19]

Everett

[11] Patent Number: 4,463,332

[45] Date of Patent: Jul. 31, 1984

[54] ADJUSTABLE, RECTILINEAR MOTION PROPORTIONAL SOLENOID

[75] Inventor: William F. Everett, Goshen, Ind.

[73] Assignee: South Bend Controls, Inc., South Bend, Ind.

[21] Appl. No.: 468,934

[22] Filed: Feb. 23, 1983

[51] Int. Cl.[3] ..... H01F 7/08

[52] U.S. Cl. ..... 335/258; 335/273; 335/274

[58] Field of Search ..... 335/229, 230, 258, 273, 335/274, 234

[56] References Cited

U.S. PATENT DOCUMENTS 3,091,725 5/1963 Huston ..... 335/230
3,379,214 4/1968 Weinberg ..... 335/234 X
3,727,900 4/1973 Casey ..... 267/160
3,940,726 2/1976 Gershnow ..... 335/274

*Primary Examiner*—George Harris
*Attorney, Agent, or Firm*—Marmaduke A. Hobbs

[57] ABSTRACT

A rectilinear motion proportional solenoid which exhibits linear output motion that is linearly proportional to the applied electrical current input. The solenoid has an adjustment mechanism which is external to the working components of the solenoid for adjusting the gain or rate of displacement of the solenoid after final assembly or while the solenoid is operating without degrading the linearity characteristics, thus allowing dynamic calibration of an operating system.

25 Claims, 9 Drawing Figures

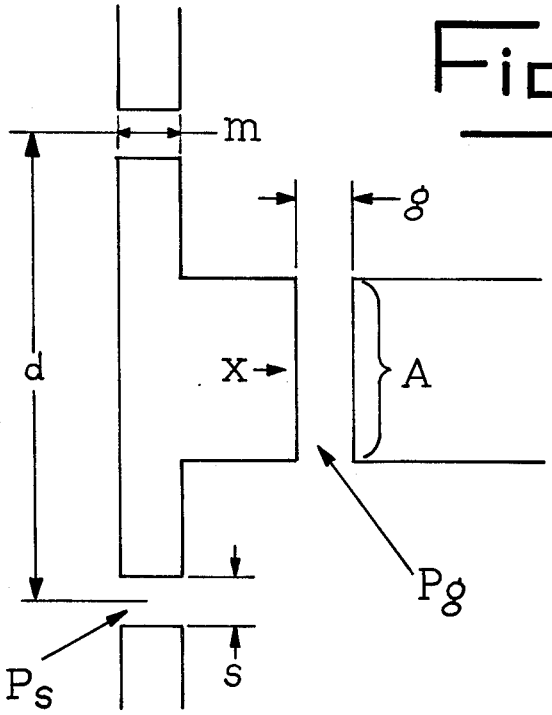
Fig. 4
Fig. 3
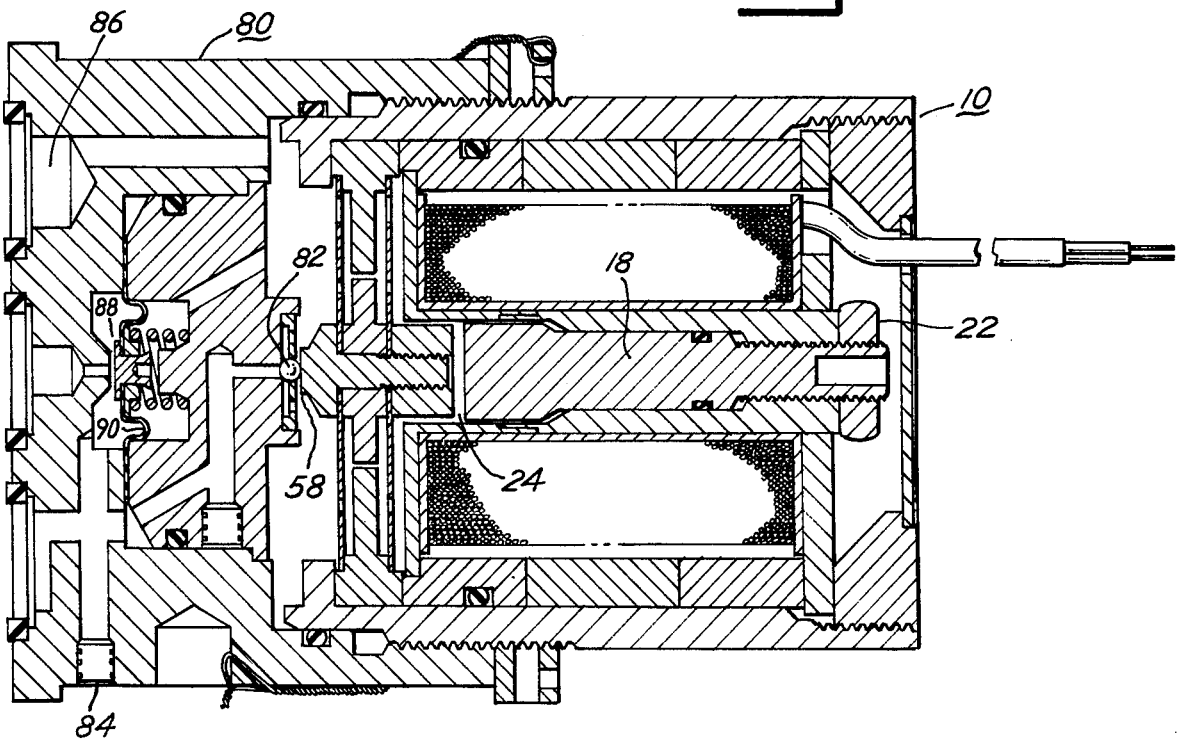

Fig. 5
TYPICAL MAGNETIC PROPERTIES OF CORE IRON MATERIAL
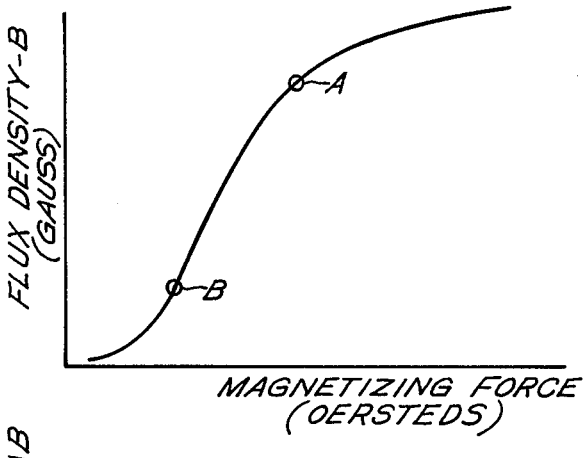
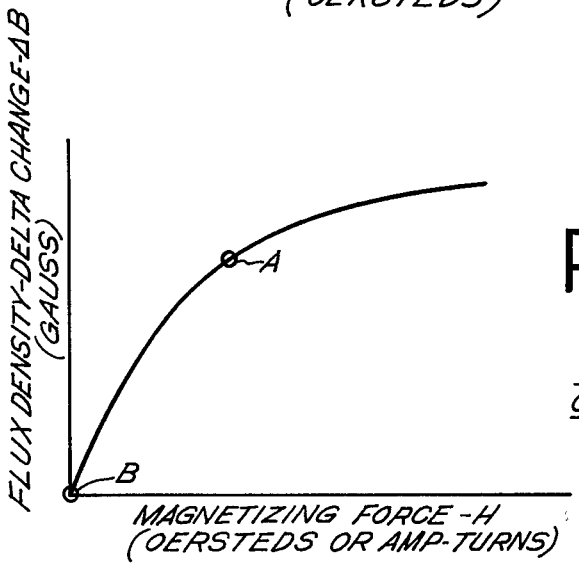
Fig. 6
MAGNETIC CIRCUIT CHARACTERISTICS (FLUX DENSITY CHANGE DUE TO ELECTRICAL CURRENT INCREASE IN COIL)
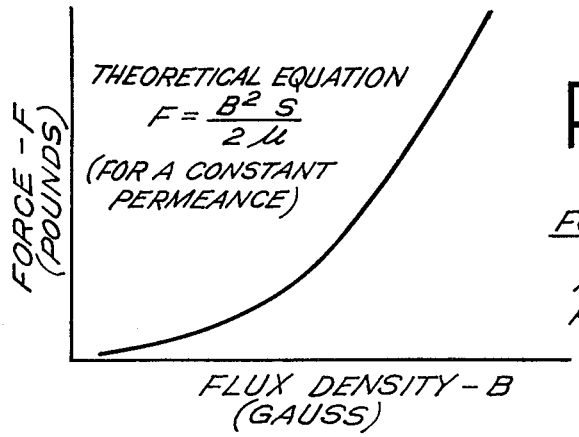
Fig. 7
FORCE VERSES FLUX DENSITY ACROSS A CONSTANT PERMEANCE AIR GAP OR CORE GAP RESULTING LINEAR CHARACTERISTIC OF FORCE-F (POUNDS) VS. MAGNETIZING FORCE-H (AMP-TURNS) BY COMBINING CURVES SHOWN ON FIGURES 6 & 7

RESULTING LINEAR CHARACTERISTIC OF STROKE DISPLACEMENT VS. MAGNETIZING FORCE-H (AMP-TURNS)

ADJUSTABLE, RECTILINEAR MOTION PROPORTIONAL SOLENOID

BACKGROUND OF THE INVENTION

A typical rectilinear motion proportional solenoid produces an output force which is non-linearly proportional to the applied electrical current input. In order to achieve linear displacement output, the currently available solenoids use some combination of non-linear spring configurations with their attendant characteristics balanced against a generated force which is non-linear with regard to electrical current input, the combination of non-linear features resulting in linear characteristics. Factory assembly and calibration are required in order for these solenoids to achieve the desired results, and when properly assembled and calibrated, the resulting output is linearly proportional to a certain defined current input.

This arrangement is adequate where a constant gain or rate is needed, rate being defined as the output displacement versus current input; however, where it is necessary to vary the rate of the armature displacement to achieve differing outputs, and linearly proportional motion is desired, these solenoids must be disassembled and the internal components must be adjusted to compensate for the desired changes in rate of displacement. The required adjustments are entirely internal to the solenoids and consist either in changing the spring rate through cam adjustments, adjusting the spring tension through repositioning, or adding or removing shims to effect changes. These are all structural changes which require physically contacting and displacing the movable armature to effect a change in performance, and any adjustments are extremely critical when working with such small distances and close tolerances as are found in solenoids of this type. Furthermore, since the very act of adjusting the armature position displaces a movable entity which is the control point or output position set point of the solenoid, proper adjustment is difficult, if not impossible. Thus, after reassembly, the unit must be tested to assure that linear output has been retained. If it has not been retained, disassembly and repositioning are indicated along with further testing after reassembly to determine whether or not the desired output has been achieved.

The difficulties encountered in making adjustments are such that most solenoids of this design are not made to be adjustable. They are designed instead to provide a specific rate of output displacement, and if a different output is required, a different solenoid must be used. Where adjustability is indicated in a spring-supported system for obtaining linear motion in an electromechanical device, as in U.S. Pat. No. 3,727,900 to Casey, a non-linear spring is used, adjustment is made to the spring rate through the addition or removal of shims, disassembly is required, and the movable armature must be contacted and physically displaced, introducing uncertainty into the control point position by the very act of adjustment. Thus, adjustment of the solenoid while coupled to the driven component, be it a valve, transducer, or other device, either at rest or while operating, is not normally possible with these solenoids.

The force generated by these solenoids and applied across the magnetic core gap to the armature is a function of the changing magnetic circuit permeance and the flux density. The magnetic circuit permeance changes with changes in the core gap or the armature stroke even with constant magnetic induction forces, resulting in definite non-linear force characteristics. Since the non-linear springs of this design are balanced against non-linear forces, with a changing force/gap curve dependent upon the magnetic circuit permeance, attempted adjustments for gain will degrade the linearity characteristics.

An additional problem encountered by the type of proportional solenoid currently available is the changes induced in the gap lengths and in the armatures themselves by expansion or contraction of the support springs, the length of the housings, or the internal components due to temperature variations. These variations also degrade the linearity characteristics due to the resulting changes induced in the output position set point or control point of the solenoid armature.

Summary of the Invention

It is, therefore, one of the principal objects of this invention to provide an adjustable rectilinear motion proportional solenoid which exhibits rectilinear output motion that is linearly proportional to the applied electrical current input through the use of linear spring configurations, minimal change in magnetic circuit permeance with armature stroke, magnetic saturation of the magnetic circuit at high induction levels, and the use of a permanent magnet to eliminate low initial incremental permeability of the magnetic circuit.

It is a further object to provide a rectilinear motion proportional solenoid which is designed with an easily and externally adjustable mechanism for adjusting the gain or output performance characteristics without degrading the linearity of output displacement even while coupled to or while operating the driven component, be it a valve, transducer or other device.

It is a further object to provide a rectilinear motion proportional solenoid in which the spring rate can be quickly and easily changed without requiring critical adjustment procedures to retain linear performance characteristics and which can be used as a rectilinear force motor, with output force linear with respect to the applied electrical current input.

A still further object of this invention is to provide a rectilinear motion proportional solenoid which is unaffected by temperature variations that can degrade linearity characteristics in other solenoid designs and which exhibits low magnetic hysteresis and therefore low movement hysteresis due to the high spring rates used and high forces created at narrow magnetic gaps.

The invention relates to an electromagnetically operated rectilinear motion proportional solenoid which is adjustable for output displacement gain or output force. The adjustment is made without requiring disassembly by means of an adjustment mechanism external to the solenoid and without degrading linearity; that is, rectilinear output motion which is linearly proportional to the applied electrical current input is preserved, unlike any other such device currently available. This is accomplished through the use of linear spring configurations and unique armature design features which produce electromagnetic forces of a linear function for affecting the armature. The solenoid uses a permanent magnet and an electromagnetic coil to produce a variable magnetic field in the magnetic circuit and thus through a trunk-polepiece so that the force acting on the armature assembly will be a function of the flux density alone and not a function of the changing magnetic circuit permeance and flux density, as in other designs. The trunk-polepiece is normally stationary and magnetically influences the movable armature; however, its position can be changed by adjusting the position of the trunk-polepiece so as to widen or narrow the core gap, whereupon the solenoid operates at its adjusted magnetic circuit permeance with linearly proportional output displacement retained, although the gain or rate of displacement itself is changed.

This solenoid can be adjusted for gain even while coupled to and operating the driven component, allowing, for the first time, dynamic calibration of an operating system while preserving the linear characteristics of the output displacement. Due to its design, this solenoid can also be used as a rectilinear force motor with output force linear with respect to the applied electrical current input.

Other objects and advantages of the present invention will become apparent from the description below with reference to the accompanying drawings.

BRIEF DESCRIPTION OF THE DRAWINGS

FIG. 3 is a longitudinal, cross-sectional view of the solenoid shown in FIG. 1, shown here coupled to a valve as one example of the solenoid's use.

FIG. 4 is a schematic diagram of the design configuration and the disposition of the trunk-polepiece and the armature assembly of the solenoid shown in the preceding figures.

FIG. 5 is a graphical representation of typical magnetic properties of core iron materials.

FIG. 6 is a graphical representation of the flux density change due to an electrical current increase in the coil.

FIG. 7 is a graphical representation of force versus flux density across a constant permeance air gap or core gap.

DETAILED DESCRIPTION OF THE PREFERRED EMBODIMENT

Figure 1:
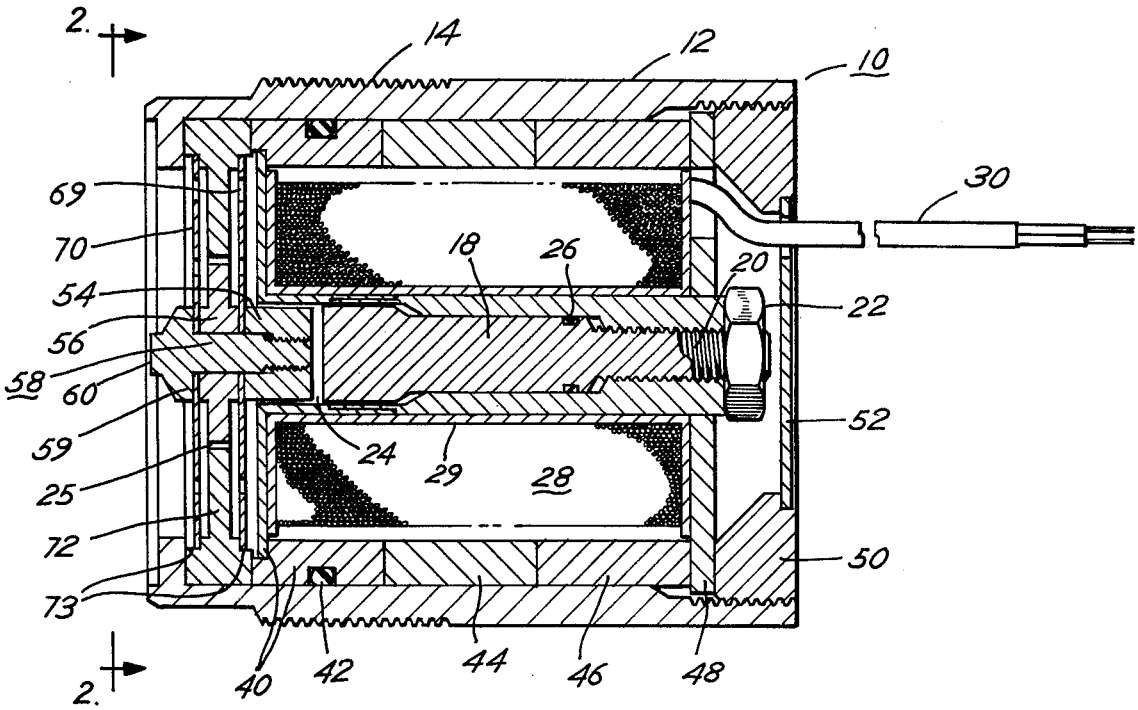
FIG. 1 is a longitudinal, cross-sectional view of the adjustable, rectilinear motion proportional solenoid embodying the present invention.

Referring more specifically to the drawings, and to FIG. 1 in particular, numeral 10 designates generally the adjustable rectilinear motion proportional solenoid embodying the present invention. The solenoid has a substantially cylindrical housing enclosing a permanent magnet which surrounds a coil assembly, which in turn surrounds a trunk-polepiece member threaded at one end for adjusting the gain or output force. A movable armature assembly supported by a ring and spring assembly is disposed at the other end of the solenoid where it affects a particular driven component upon energization of the solenoid. The magnetic circuit of the present invention includes the trunk-polepiece, the armature, the armature plate, the armature retainer, the ring and spring assembly, the permanent magnet, a core assembly, a rear ring, and a rear plate. The force generated by the solenoid is of a linear function and is applied through the trunk-polepiece and across the core and side gaps to the armature, resulting in displacement of the output contact point whereby a particular driven component is affected.

This generated force must be of a linear function, with respect to the applied electrical current input, when linear rate springs are used, in order to produce linear output characteristics. The linearization of this generated force is accomplished by the unique design features of this solenoid and will be explained with reference to the drawings.

Housing member 12 encloses the internal components of the solenoid and is threaded at 14 for securing the solenoid to its driven component, which may be a valve, transducer, or other device. A trunk-polepiece 18 of magnetic material is disposed in the center of the solenoid and has a threaded portion at 20 on the end opposite the armature for adjustability. The trunk-polepiece is adjusted by rotating the polepiece with a wrench or screwdriver to cause threaded portion 20 to move the polepiece longitudinally in the solenoid and thus relative to the armature. Utilizing the magnetic properties of the iron, sizing of the trunk-polepiece, as in this embodiment, causes it to be the first area to begin saturating as increasing magnetizing force is applied and is the first feature of this solenoid which shapes and linearizes the generated force. Typical electromagnetic materials, core irons specifically, exhibit a phenomenon known as magnetic saturation which occurs when the magnetizing force that is applied saturates the core iron so that increases in amp-turns (oersteds) produce smaller and smaller increases in flux density (gauss) as shown in FIG. 5. Beyond a certain magnetizing force, indicated by Point A on FIG. 5, the induced magnetic field or flux density fails to increase proportionately with increasing magnetizing force.

Situated on the threaded end of the trunk-polepiece is a nut 22 which is loosened for adjusting the position of the trunk-polepiece as described above and thereby adjusting the size of the core gap 24, formed between the trunk-polepiece and the armature, whereupon the nut is again tightened. An O-ring 26 is disposed around the trunk-polepiece, providing a fluid-tight seal for the axially movable trunk-polepiece. Surrounding the trunk-polepiece is an electromagnetic coil 28 wound on a bobbin 29 and connected to a suitable DC power source (not shown) by wire leads 30 for energizing the solenoid. Surrounding the coil and enclosing the trunk-polepiece, thus forming a part of the magnetic circuit of the solenoid, is a core assembly 40 with an O-ring 42 around the body of the core assembly serving as a fluid-tight seal, the core assembly having sized portions and a threaded portion corresponding to the sized and threaded trunk-polepiece for keeping air gaps to a minimum, an annular permanent magnet 44, an annular rear ring 46 and a rear plate 48. The permanent magnet creates a field of predetermined flux density in the trunk-polepiece, indicated by point B on FIG. 5, and, upon energization of the coil, the field produced by the permanent magnet is additive to the field produced by the coil. Since the magnetic circuit necessarily contains air gaps, the incremental permeability of the magnetic circuit is low at low induction levels. By providing a permanent magnet, the operating range of the core iron's magnetic characteristics is shifted up to a higher or threshold induction level which, in effect, upon energization of the coil, causes the coil to "start" at a higher incremental permeability, which is also somewhat constant over a range described from about point B to about point A on FIG. 5, also aiding in the linear shaping of the force generated across the core gap 24.

An annular locking ring 50 is provided at the end opposite the armature and threadedly engages the inner body surface of the solenoid for holding the internal parts in place, and a cap 52 with a hole provided for the wire leads is disposed in grooves provided in the locking ring for covering the adjusting nut 22. This cap is easily removed when adjustments to the position of the trunk-polepiece are required.

The armature assembly includes an armature 54 with a hollow threaded center, an armature plate 56, and an armature retainer 58 with a threaded end for engaging the armature, the end opposite the threaded end having a circular flange 59 surrounding the body of the armature retainer, said retainer having a flat outer surface 60 which is the output control point for this particular embodiment. The armature retainer 58 threadedly engages the armature, thereby holding the armature plate and the armature together. The armature assembly is supported by two flat disc-shaped linear rate springs, inner spring 69 and outer spring 70, which are disposed in a spring ring 72 with ridges 73 designed for brazing attachment of the springs. With the armature retainer in place, the armature assembly and the ring and spring assembly comprise a unit which is easily removed for changing the springs where a different spring rate is required. The spring ring has a hole in its center for accepting the armature assembly, and the distance between the armature plate and the edge of the hole in the spring ring comprises the side gap 25 across which the induced magnetic field flows.

The design configuration of the armature assembly, the ring and spring assembly, and the trunk-polepiece is the third feature of the solenoid which shapes and linearizes the force generated by the solenoid across the core gap. The spatial relationships and the specific sizing of the trunk-polepiece 18, the armature 54, the armature plate 56, the linear springs 69 and 70 and the spring ring 72 have been specifically chosen and designed to result in a minimal change in the magnetic circuit permeance. Thus, as shown in FIG. 4, the effective area of the armature and the trunk-polepiece (A), the diameters of the trunk-polepiece and the armature, the mean armature plate diameter (d), the side gap interface length (m), the core gap clearance (g), and the side gap clearance (s) have all been calculated and disposed in the solenoid to serve this end. Previous solenoid designs all appear to make no effort to maintain a nearly constant magnetic circuit permeance, thus resulting in definite non-linear force characteristics since the magnetic circuit permeance changes with changes in the core gap or armature stroke, even with constant magnetic induction forces. This is a primary reason why previous proportional solenoids can not be adjusted for gain without degrading the linearity characteristics, since their non-linear springs are balanced against a changing force/gap curve dependent upon the magnetic circuit permeance. The permeance of an electromagnetic circuit is a measure of the conductivity of the flux lines or lines of force. For a given and fixed magnetizing force, the greater the circuit permeance, the greater the established lines of force, or resulting flux density. As the magnetic circuit permeance increases using a fixed magnetizing force, the resulting flux density increases. Thus, as the core gap in a typical proportional solenoid closes, the circuit permeance, the flux density, and the force attracting the armature all increase, causing a snap action "pull-in" in the solenoid. By keeping the permeance of a magnetic circuit constant with regard to armature stroke, the force developed against the armature would be a function of the magnetic flux density alone. In addition, since the permeance of the magnetic circuit is nearly constant, the relative core gap could be changed to achieve adjustable gain characteristics without changes in force developed against the armature, or displacement of the operating point, or shifts in a control point of a valve assembly. To achieve this, the configuration of the armature assembly, the ring and spring assembly, and the adjustable trunk-polepiece has been designed such that the magnetic circuit permeance remains nearly constant, independent of armature position. This relationship has been theoretically derived based on electromagnetic theory as described below. Referring again to FIG. 4, the letters designate the following:

d-Mean armature plate diameter
m-Side gap interface length
s-Side gap clearance
g-Core gap clearance
x-Armature displacement
A-Effective area of armature and trunk-polepiece
$P_t$-Total gap permeance
$P_g$-Core gap permeance
$P_s$-Side gap permeance The derivation proceeds as follows:

$$P_g = \frac{\mu A}{g} \qquad P_s = \frac{\mu 2\pi dm}{s}$$

$$\frac{1}{P_t} = \frac{1}{P_g} + \frac{1}{P_s} = \frac{g}{\mu A} + \frac{s}{\mu 2\pi dm}$$

Using this theoretical relationship, the effective area of the armature and the trunk-polepiece (A) has been designed so that:

$$A = 2\pi \mathrm{dm}$$

Substituting this in the above equation yields:

$$\frac{1}{P_t} = \frac{g}{\mu 2\pi dm} + \frac{s}{\mu 2\pi dm} = \frac{g+s}{\mu 2\pi dm} \text{ or } P_t = \frac{\mu 2\pi dm}{g+s}$$

Again, by design, the sum of the side gap clearance (s) and the core gap clearance (g) minus the armature displacement has been made equal to the side gap interface length minus the armature displacement or:

$$s+q-x=m-x$$

Substituting this in the above equation yields:

$$P_t = \mu 2\pi d\left(\frac{m-x}{s+g-x}\right)$$

Therefore, for small changes in the side gap interface length (m) and the core gap clearance (g) by the amount of armature displacement (x), the total gap permeance ($P_t$) remains nearly constant. Thus, as adjustments in the position of the trunk-polepiece are made and the core gap is changed, the core gap clearance and the side gap interface length change equally by the amount of armature displacement and the total gap permeance remains nearly constant, as shown above, with the result that the force attracting the armature becomes a function of the flux density alone and not a function of the magnetic circuit permeance and flux density, as is the case with other currently available solenoids of this type.

Figure 8:
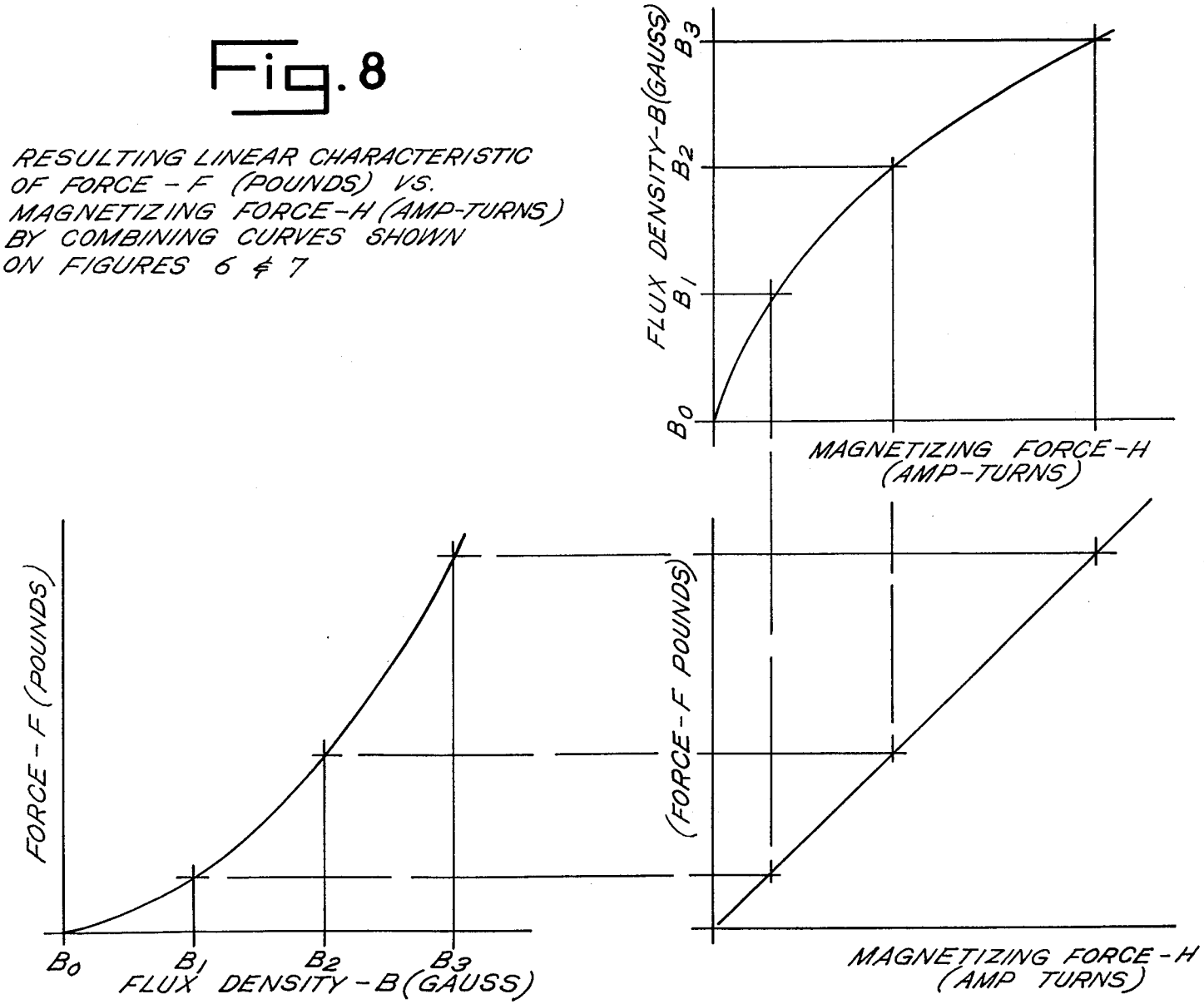
FIG. 8 is a comparative graphical representation of the resulting linear characteristic of force—F (pounds) versus magnetizing force—H (amp-turns) by combining the curves shown in FIGS. 6 and 7.
Figure 9:
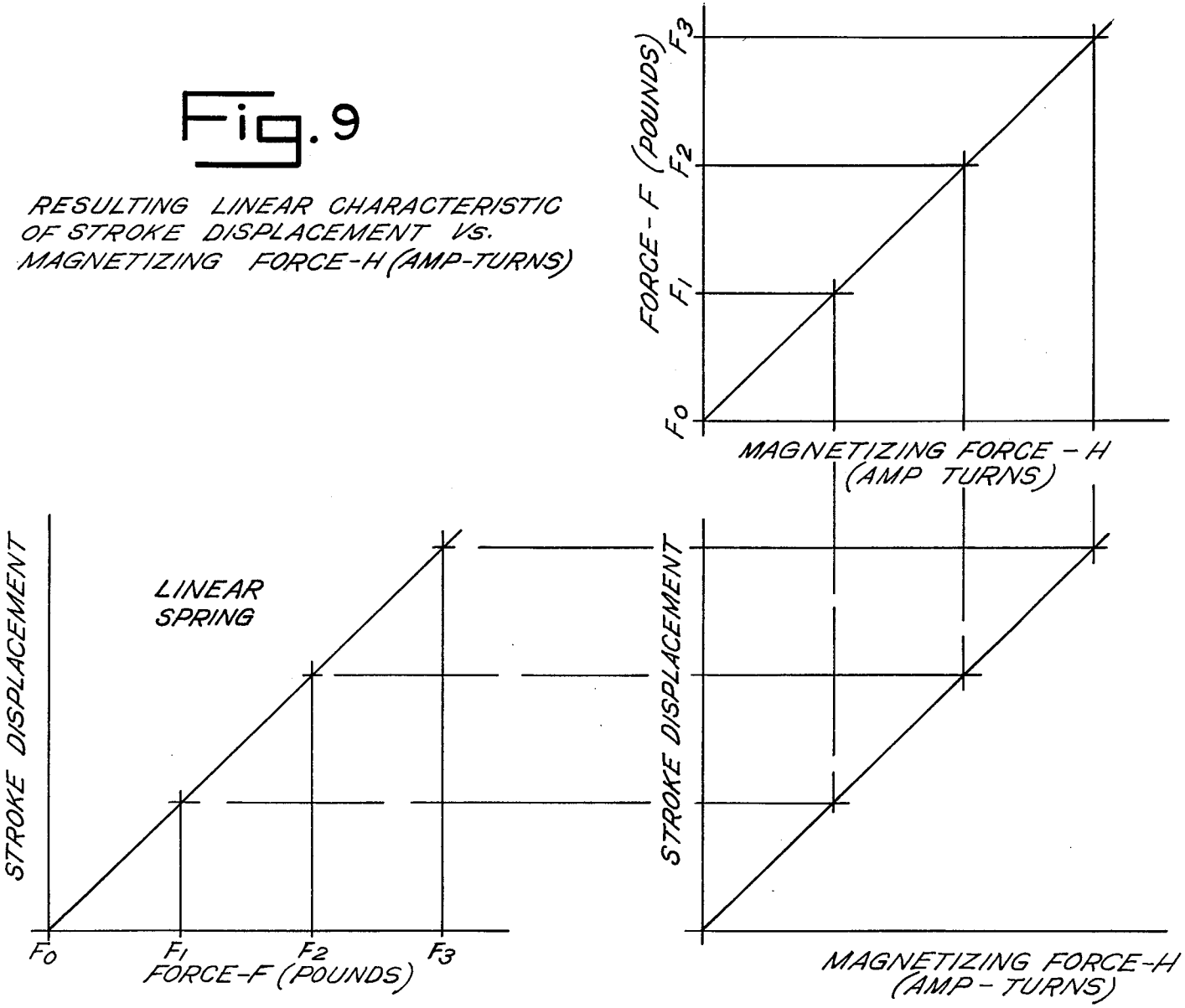
FIG. 9 is a comparative graphical representation of the resulting linear characteristic of stroke displacement versus magnetizing force—H (amp-turns) by combining the curve obtained in FIG. 8 of force versus magnetizing force with the curve shown here of stroke displacement versus force for a linear spring.

Referring again to FIG. 5, disregarding the initial flux level generated by the permanent magnet, indicated at Point B, and considering only the magnetizing force created by the electrical coil, FIG. 6 is a plot of the flux density change due to an electrical current increase in the coil or delta flux density change versus delta amp-turns change. Using the theoretical relationship described above, the force created across the core gap can be described and plotted in relation to the flux density across the core gap, as shown in FIG. 7, for a constant permeance air gap or core gap. The non-linear characteristics shown in FIGS. 6 and 7 are combined in FIG. 8 to describe the resulting condition of a linear characteristic between the force generated across the core gap versus the magnetizing force in amp-turns. This linear relationship can then be combined with the linear relationship obtained between force versus stroke displacement using a linear spring, showing the resulting condition of a linear relationship achieved between rectilinear output motion versus electrical current input, as indicated in FIG. 9.

The gain or rate of rectilinear motion versus electrical current input can then also be adjusted without substantial change in the linearity performance characteristic. The armature assembly and the ring and spring assembly are designed and perform as a single unit, and the actual position of the armature and the armature plate relative to the spring ring is not changed with changes in the core gap through adjustment of the position of the trunk-polepiece. Therefore, as the adjustment is made and the core gap is increased or decreased, the magnetic circuit permeance changes to a new value and the resulting flux density generated versus magnetizing force changes, causing an increase or decrease in gain or rate of displacement, respectively, but linearity characteristics are preserved because the armature itself is not displaced, and therefore, the previously described relationship between the armature assembly position and spring ring remain unaffected.

Also, since the armature, the armature plate, the armature retainer, and the linear springs are all supported by the spring ring, which is clamped directly in line with the mounting threads at one end of the solenoid, the solenoid is unaffected by temperature variations which cause expansion or contraction in the housing or the internal components and thus a shift in the output control point, which occurs in many of the currently available solenoids of this type.

Figure 2:
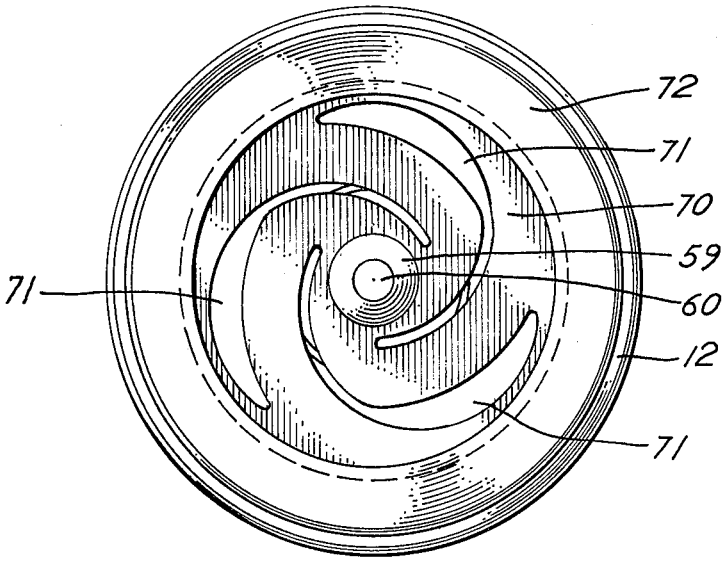
FIG. 2 is an end view of the solenoid shown in FIG. 1, taken from the left side on line 2—2 of FIG. 1.

FIG. 2 shows the configuration of the spring ring and springs used in the present invention, showing clearly the design of the linear rate, disc-shaped spring 70 with arcuate slots 71 radiating outwardly in a spiral configuration around the center from positions near the hole in the center of the spring. The thickness of the linear springs used in this design determines the spring rate, and in this particular embodiment, a combined spring rate of 1000 pounds/inch is used. The value can be changed by the substitution of different springs, depending on the requirements of the particular application. With the linear springs used in this design, the spring rate changes less than 10% over the armature stroke range, and the springs achieve linear motion relative to the input current when the generated force against the spring is linear with respect to the input current, as described above and plotted in FIG. 9. As noted, different springs may be substituted in the solenoid to allow for variations of the gain ranges, or where stiffer support is required for vibration-prone applications, or to change the natural frequency of the spring mass system.

In FIG. 3, the adjustable rectilinear motion proportional solenoid embodying the present invention is shown coupled to a valve assembly 80 as one example of the solenoid's use. The force generated by the solenoid across the core gap results in displacement of the armature retainer 58 which acts to control ball valve 82 between inlet passage 84 and outlet passage 86 to control the flow of fluid through the valve. A pressure regulator valve 88 has a spring loaded diaphragm 90 subjected to inlet and outlet pressures for maintaining a substantially constant differential pressure across ball valve 82. The displacement of the armature retainer can be varied by loosening the adjusting nut 22 and adjusting the position of the trunk-polepiece 18 by rotating it to cause threaded portion 20 to move the polepiece longitudinally, whereupon the adjusting nut is retightened and the trunk-polepiece again becomes a stationary member which influences and move magnetically the movable armature assembly.

In the use and operation of the present invention, the solenoid is coupled to a valve or other device by the threaded section 14 of body 12. The electrical leads 30 are attached to a suitable DC power source and the coil is energized, creating an electromagnetic field which is additive to the field produced by the permanent magnet 44. The magnetic circuit which operates up to and into magnetic saturation of the core iron trunk-polepiece, results in high forces which require high spring rates when relatively narrow core and side gaps are used, as in the present embodiment of the invention. The high forces and stiff support springs, with a combined spring rate of approximately 1000 pounds/inch, working at the narrow gaps used herein, result in low magnetic hysteresis and therefore low movement hysteresis. This feature of low hysteresis has not been effectively addressed in the prior art due to the inability of currently available rectilinear motion proportional solenoids to operate at the narrow gaps used in the present design. The magnetic field produced by the coil and the permanent magnet is applied through the trunk-polepiece and across the core and side gaps to the armature 54, attracting the armature to the trunk-polepiece, the predetermined theoretical and physical relationship being that the force is proportional to the square of the flux density. The force applied results in displacement of the armature retainer 58, which is the output contact point or control point of the solenoid that affects the particular driven component.

Adjustments can be made in the position of the trunk-polepiece by loosening the adjusting nut 22 and turning the trunk-polepiece, which changes the length of the core gap. This changes the magnetic circuit permeance and the flux density generated across the core gap with corresponding changes in output motion, but the linear characteristics of the output motion are preserved because the relative position of the armature and the spring ring assembly remain constant due to their unitary assembly and the fact that the movable armature is not physically displaced. The adjusted position of the trunk-polepiece is then fixed and the trunk-polepiece again becomes a stationary member which magnetically affects the armature. Retention of linearity is possible because linear motion is achieved independently of spring bias, spring rate change, or armature position. The magnetic circuit permeance is kept nearly constant at its adjusted level so that the force developed and applied to the armature is a function of the flux density alone and linearity is preserved while the gain changes. The adjustments and calibrations of the specific displacement desired can be made after final assembly, either on the uncoupled solenoid alone or after its installation on a valve or other device, and do not require disassembly. This allows dynamic calibration of gain while the solenoid is energized and operating, something heretofore unattainable. Changing the spring rate requires disassembly but involves merely substituting one set of springs for another with output displacement calibration performed after reassembly.

While one embodiment of an adjustable rectilinear motion proportional solenoid has been shown and described in detail herein, various changes and modifications can be made without departing from the scope of the invention.

I claim:

1. A rectilinear motion proportional solenoid comprising a housing having therein a movable armature assembly of magnetic material, substantially linear spring means for acting on said armature assembly, a holding means for supporting said armature assembly and said spring means, an electromagnetic coil and an annular permanent magnet for producing a magnetic field, a normally fixed, axially movable trunk-polepiece of magnetic material for acting on said armature assembly, and an adjustment means for changing the position of said trunk-polepiece relative to said armature assembly, said holding means including an annular member with a hole in its center for receiving said armature assembly and forming a side gap therebetween, and means on said annular member for receiving and retaining said spring means.

2. A solenoid as defined in claim 1 in which said housing is cylindrical having a hollow center for receiving the internal components of said solenoid, a first opening on one end of said housing for protrusion of said armature assembly, a second opening on the opposite end of said housing for access to said adjustment means, a protective end cap for said opposite end of said housing, and a threaded portion on the outer periphery of said housing for threadedly connecting said solenoid to a component to be driven.

3. A solenoid as defined in claim 2 in which said armature assembly includes an armature with a hollow threaded center portion, an annular armature plate with a hole in its center, and an armature retainer with a threaded end for extending through said armature plate and into said hollow threaded center portion of said armature for threadedly connecting said armature retainer to said armature, whereby said armature plate is held therebetween, the end of said armature retainer opposite said threaded end extending outwardly from said housing for affecting said driven component, and a flange on said armature retainer for holding said spring means.

4. A solenoid as defined in claim 3 in which said spring means comprise two annular linear springs with substantially constant spring rates, each of said springs having a plurality of arcuate slots, said slots beginning near the center of said springs at selected points and extending outwardly in a spiral configuration around said center, and each of said springs having a hole in the center for receiving said armature retainer.

5. A solenoid as defined in claim 3 in which said spring means has two springs, one of said springs being seated at its inner edge between said armature and said armature plate, and the second of said springs being seated at its inner edge between said armature plate and said flange of said armature retainer, whereby said armature retainer secures together said springs, said armature plate and said armature by threadedly engaging said armature.

6. A solenoid as defined in claim 5 in which said electromagnetic coil is disposed around said trunk-polepiece and said permanent magnet is disposed around said coil whereby the magnetic field produced by said coil is additive to the magnetic field produced by said magnet.

7. A solenoid as defined in claim 3 in which said trunk-polepiece is disposed axially within said housing having a wide end disposed near said armature and forming a core gap therebetween, and a narrow end being threaded and forming a part of said adjustment means, the effective area of said trunk-polepiece and said armature being equal to two times pi times the mean diameter of said armature plate times the interface length of said side gap.

8. A solenoid as defined in claim 7 in which said trunk-polepiece is rotatable within said solenoid, said adjustment means includes a threaded means on said trunk-polepiece for moving said trunk-polepiece longitudinally to change the space relationship between said polepiece and said armature assembly, whereby the output displacement of said solenoid is changed, and in which the width of said side gap plus the width of said core cap minus the amount of displacement of said armature is equal to the interface length of said side gap minus the amount of displacement of said armature.

9. A solenoid as defined in claim 8 in which said adjustment means includes a nut disposed on said threaded means of said trunk-polepiece for retaining said trunk-polepiece in an adjusted position relative to said armature.

10. A solenoid as defined in claim 9 in which said adjustment means is accessible externally for adjusting the position of said trunk-polepiece after said solenoid is assembled.

11. A solenoid as defined in claim 1 in which said trunk-polepiece is rotatable within said solenoid, and said adjustment means includes a threaded means on said trunk-polepiece for moving said trunk-polepiece longitudinally to change the space relationship between said polepiece and said armature assembly, whereby the output displacement of said solenoid is changed.

12. A solenoid as defined in claim 11 in which said adjustment means includes a nut on one end of said trunk-polepiece for locking said trunk-polepiece in an adjusted position.

13. A rectilinear motion proportional solenoid comprising a cylindrical housing having therein an electromagnetic coil for inducing a magnetic field, an annular permanent magnet for inducing a magnetic field which is additive to the field induced by said coil, a movable armature assembly of magnetic material, a trunk-polepiece of magnetic material having one end disposed near said armature assembly and forming a core gap therebetween, a substantially linear spring means for supporting said armature assembly, and a holding means having a center hole for receiving and retaining said armature assembly and said spring means with the edge of said center hole being disposed near said armature assembly and forming a side gap therebetween.

14. A solenoid as defined in claim 13 in which said armature assembly includes an armature with a hollow threaded center portion, an annular armature plate with a hole in its center, and an armature retainer with a threaded end for extending through said armature plate and into said hollow threaded center portion of said armature for threadedly connecting said armature retainer to said armature, whereby said armature plate is held therebetween, the end of said armature retainer opposite said threaded end extending outwardly from said housing for affecting a driven component, and a flange on said armature retainer for holding said spring means.

15. A solenoid as defined in claim 14 in which the relationship $A=2\pi dm$ is maintained by said armature assembly, said trunk-polepiece, and said holding means wherein:

A = effective area of said armature and said trunk-polepiece d = mean diameter of said armature plate m = interface length of said side gap.

16. A solenoid as defined in claim 15 in which the relationship $s+g-x=m-x$ is maintained by said armature assembly, said trunk-polepiece, and said holding means wherein:

s = width of said side gap g = width of said core gap m = interface length of said side gap x = amount of armature displacement.

17. A solenoid as defined in claim 16 in which the diameter of said trunk-polepiece is substantially equal to the diameter of said armature.

18. A rectilinear motion proportional solenoid comprising a cylindrical housing having therein an annular permanent magnet for producing a magnetic field, an electromagnetic coil for producing an additional magnetic field, a movable armature assembly of magnetic material, an adjustable core iron member of magnetic material for affecting said armature assembly and forming a core gap therebetween whereby said armature assembly affects a driven component, a substantially linear spring means biased against movement of said armature assembly, and an adjustment means for changing the position of said core iron member relative to said armature assembly whereby said core gap is changed, said coil being disposed around said core iron member and said magnet being disposed around said coil for producing an additive magnetic field for saturating said core iron member with magnetic flux.

19. A solenoid as defined in claim 18 in which said core iron member includes an axially movable trunk-polepiece which is adjustable for changing the size of said core gap, whereby the output displacement and force produced by said solenoid are changed without varying the electrical current input.

20. A solenoid as defined in claim 19 in which said spring means includes two linear, constant rate springs of a substantially flat disc-shaped configuration, with a center hole and a plurality of arcuate slots extending outwardly in a spiral configuration from points near said center hole.

21. A solenoid as defined in claim 20 in which said armature assembly is supported by said springs, and said solenoid has a ring member which supports said springs and has a center hole for receiving said armature assembly and forming a side gap therebetween.

22. A solenoid as defined in claim 21 in which said trunk-polepiece has a threaded end and said adjustment means includes a nut disposed on said threaded end for holding said trunk-polepiece in an adjusted position.

23. A solenoid as defined in claim 22 in which said adjustment means is accessible externally of said solenoid for adjusting the output force while said solenoid is operating.

24. A rectilinear motion proportional solenoid comprising a housing having therein an armature assembly having an armature plate, substantially linear spring means for acting on said armature assembly, a holding means for supporting said armature assembly and said spring means and having an annular member with a hole in its center for receiving said armature assembly and forming a side gap therebetween, an electromagnetic coil for producing a magnetic field, and a trunk-polepiece of magnetic material for acting on said armature assembly, said trunk-polepiece being disposed axially within said housing and having an end disposed near said armature and forming a core gap therebetween, the effective area of said trunk-polepiece and said armature being equal to two times pi times the mean diameter of said armature plate times the interface length of said gap.

25. A rectilinear motion proportional solenoid as defined in claim 24 in which the width of said side gap plus the width of said core gap minus the amount of displacement of said armature is equal to the interface length of said side gap minus the amount of displacement of said armature.

* * * * *